US009339068B2

(12) United States Patent
Baacke

(10) Patent No.: US 9,339,068 B2
(45) Date of Patent: May 17, 2016

(54) GLOVE WITH LAMINATE CONSTRUCTION

(71) Applicant: LF Fashion Pte. Ltd., Singapore (SG)

(72) Inventor: Dennis R. Baacke, Irma, WI (US)

(73) Assignee: LF FASHION PTE. LTD., Singapore (SG)

( * ) Notice: Subject to any disclaimer, the term of this patent is extended or adjusted under 35 U.S.C. 154(b) by 0 days.

(21) Appl. No.: 14/557,831

(22) Filed: Dec. 2, 2014

(65) Prior Publication Data

US 2015/0157070 A1 Jun. 11, 2015

Related U.S. Application Data

(60) Provisional application No. 61/912,170, filed on Dec. 5, 2013.

(51) Int. Cl.

| | |
|---|---|
| ***A41D 19/00*** | (2006.01) |
| ***A41D 19/02*** | (2006.01) |
| ***A41D 19/04*** | (2006.01) |

(52) U.S. Cl.

CPC ..... *A41D 19/0006* (2013.01); *A41D 19/001* (2013.01); *A41D 19/0055* (2013.01); *A41D 19/02* (2013.01); *A41D 19/04* (2013.01)

(58) Field of Classification Search

CPC . A41D 19/00; A41D 19/015; A41D 19/0006; A41D 19/02; A63B 71/148; A61B 19/04

USPC ..... 2/159, 161.1, 161.6, 164, 167, 169, 910

See application file for complete search history.

(56) References Cited

U.S. PATENT DOCUMENTS

| | | | | |
|---|---|---|---|---|
| 4,928,322 | A * | 5/1990 | Bradfield | 2/169 |
| 5,402,540 | A | 4/1995 | Williams | |
| 5,442,818 | A | 8/1995 | Loos | |
| 5,483,703 | A | 1/1996 | Williams | |
| 5,655,226 | A | 8/1997 | Williams | |
| 5,732,413 | A | 3/1998 | Williams | |
| 5,740,551 | A * | 4/1998 | Walker | 2/16 |
| 5,766,400 | A * | 6/1998 | Gallagher, Jr. | 156/251 |
| 5,822,795 | A | 10/1998 | Gold | |
| 5,832,539 | A | 11/1998 | Williams | |
| 5,981,019 | A | 11/1999 | Goodwin et al. | |
| 6,716,778 | B1 | 4/2004 | Hottner | |
| 6,807,683 | B2 | 10/2004 | Williams | |

(Continued)

FOREIGN PATENT DOCUMENTS

| | | |
|---|---|---|
| WO | 0156415 | 8/2001 |
| WO | 0174186 | 10/2001 |
| WO | 2010020277 | 2/2010 |

OTHER PUBLICATIONS

PCT/IB2014/003079, International Search Report and Written Opinion dated Jun. 1, 2015, 11 pages.

*Primary Examiner* — Tejash Patel

(74) *Attorney, Agent, or Firm* — Boyle Fredrickson, S.C.

(57) ABSTRACT

The present invention is a pre-shaped article of clothing formed with an inner and/or outer layer and an intermediate layer secured to the inner or outer layer, wherein the intermediate layer includes an adhesive positioned thereon in a non- or discontinuous manner to secure the intermediate layer to the inner or outer layer. The adhesive is heat-activated to form bonds between the inner and/or outer layer and the intermediate layer without any application of compressive forces to the layers when forming the glove.

15 Claims, 5 Drawing Sheets

(56) References Cited

U.S. PATENT DOCUMENTS

| | | | | |
|---|---|---|---|---|
| 7,162,748 | B2 | 1/2007 | Hottner et al. | |
| 7,451,497 | B2 * | 11/2008 | von Blucher | 2/161.6 |
| 7,624,456 | B2 | 12/2009 | Williams et al. | |
| 8,256,030 | B2 | 9/2012 | Williams et al. | |
| 2006/0150299 | A1 | 7/2006 | Geng | |

* cited by examiner

GLOVE WITH LAMINATE CONSTRUCTION

CROSS-REFERENCE TO RELATED APPLICATIONS

This application claims priority from U.S. Provisional Patent Application Ser. No. 61/912,170, filed on Dec. 5, 2013, the entirety of which is hereby expressly incorporated by reference herein.

FIELD OF THE INVENTION

The present invention relates to gloves, and more specifically to gloves having a laminate construction.

BACKGROUND OF THE INVENTION

Gloves have long been used to cover an individual's hand in various circumstances and conditions, such as to provide increased gripping ability to the individual's hands when working or playing sports. Gloves have been modified over the years to provide enhanced gripping ability or functionality to an individual wearing the gloves as a result of various additions made to the glove construction, including but not limited to various components attached to the exterior of the gloves, to the interior of the gloves, and modifications to the materials from which the gloves are manufactured.

To enhance these abilities of gloves, many different types of gloves are formed with a laminate construction. The laminate construction of these gloves provides the gloves with various layers of materials that enable the glove to have different attributes based on the types of materials forming the various layers off the glove.

However, while the different materials forming the various layers of the glove provide multiple options for the construction of gloves to provide the desired attributes to the glove, the laminate constructions of these type of gloves have inherent shortcomings with regard to the their construction. In particular, the laminate construction requires that the glove be constructed either of pieces of the selected pre-formed laminate material or by laminating the individual layers of the glove together after forming the layers into the desired shape for the glove.

In the first construction, while the formation of the laminate panels used to form the glove can be done relatively easily, the engagement of the panels into the ultimate form of the glove results in seams between the panels.

In the second construction, while the individual layers can potentially be formed without seams, the engagement of the layers with one another is problematic as it is very difficult to achieve a proper bond between the various layers in a consistent manner across the entire surface area of the glove, especially in those areas with limited exposed surface area, such as the tips of the fingers of the glove.

Therefore, it is desirable to develop a glove having a laminate construction to provide the desired attributes to the glove, but that can be formed with a secure connection between the various layers at key points on the glove without the need for seams that secure the layers of the laminate to one another.

SUMMARY OF THE INVENTION

According to a one aspect of the present disclosure, a glove is provided in which the glove is formed from a number of layers of material, with each layer being generally continuous around the entire glove. In one exemplary embodiment, the glove includes an inner layer and/or an outer layer having the desired properties for the resulting glove construction, and an intermediate layer having the desired properties and capable of being adhered to the inner layer and/or outer layer or adhering the inner layer and/or outer layers to one another. The intermediate layer in one exemplary embodiment is formed of a continuous layer or bladder of a waterproof, breathable thermoplastic material. The intermediate layer includes or can be formed to function as a heat-activated adhesive positioned over the interior and exterior surfaces of the bladder. The adhesive or adhesive portions of the bladder can be positioned or formed on the intermediate layer in a continuous or in a non-continuous manner, such by placing dots of the adhesive over the interior and exterior surfaces of the bladder. In one exemplary embodiment, the positioning of the adhesive on the surfaces of the bladder in this non-continuous manner enables the glove to retain is flexibility and stretchability when formed in the glove by leaving the bladder an amount of flexibility in the areas between the locations where the adhesive is applied. This is accomplished with this glove construction while also functioning to improve the liner retention of the glove construction, eliminating or at least reducing slippage between the palm of the outer layer and the palm of the inner layer, and reducing the space between the inner and outer layers in which moisture can be retained within the interior of the glove.

According to another aspect of the present disclosure, in an exemplary embodiment of the invention the activation of the adhesive positioned on or formed as a part of the bladder can be accomplished by utilizing a suitable heat source to melt the adhesive in or on the bladder, optionally without the need for the compression of the layers to one another, to form the laminate glove construction.

According to still another aspect of the present disclosure, in an exemplary embodiment of the invention, the method for forming the glove results in a glove having enhanced flexibility as a result of the form utilized to initially shape the glove. The contours of the form on which the various layers of the glove are positioned during construction result in initial glove construction with inherent conformance to a natural relaxed hand position. With this configuration, the glove formed thereon has a shape and pre-curved fabric allowance for the flexibility of the glove towards both hand fully opened and closed positions. This inherent flexibility of the glove is present without regard to the ultimate configuration of the bladder due to the shape of the inner and outer layers as positioned on the pre-shaped or curved form.

Numerous other features, objects and advantages of the present disclosure will be made apparent from the following detailed description taken together with the drawing figures.

BRIEF DESCRIPTION OF THE DRAWINGS

The drawings illustrate the best mode currently contemplated as practicing the present invention.

In the drawings.

DETAILED DESCRIPTION OF THE INVENTION

Figure 1:
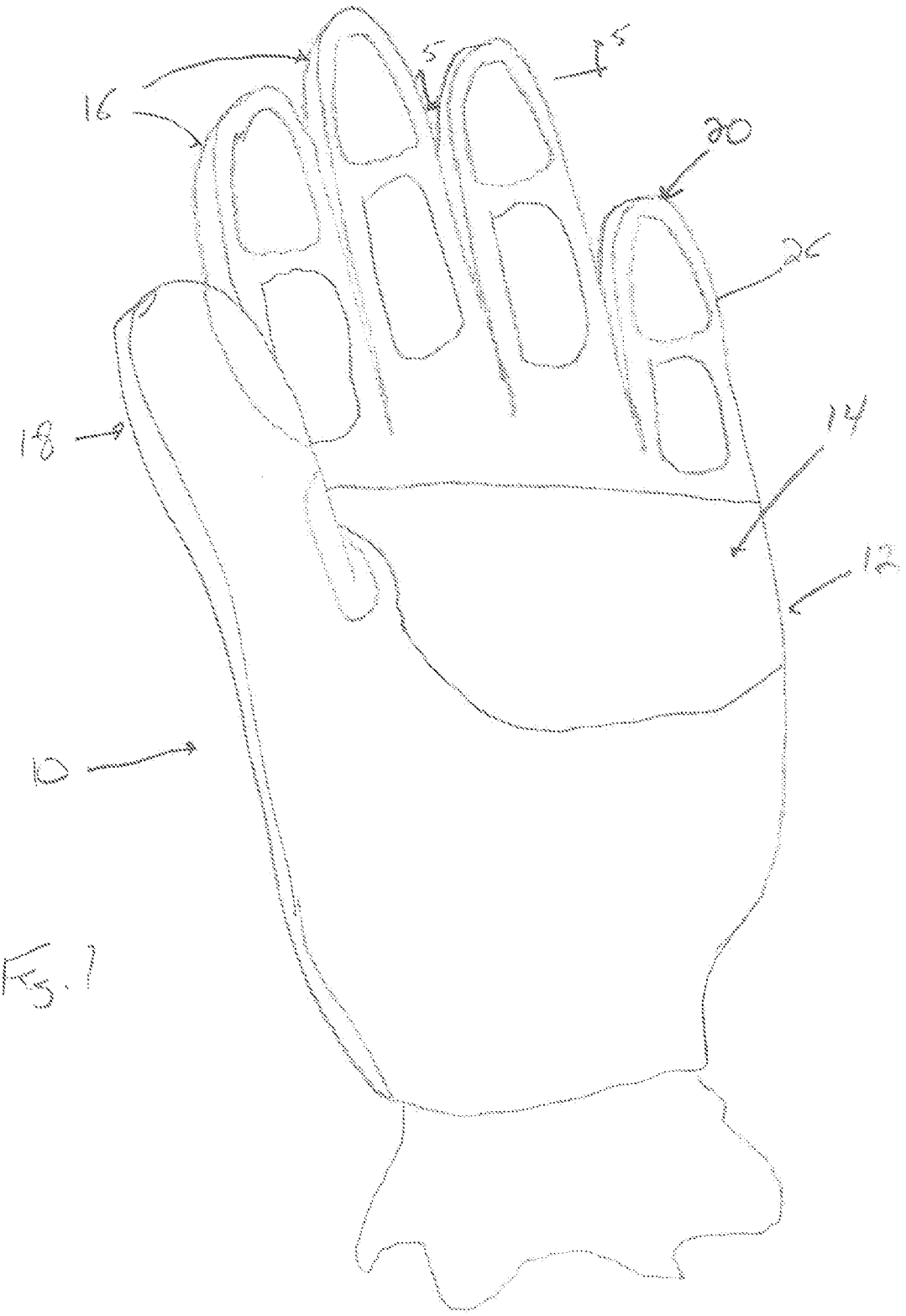
FIG. 1 is a perspective view of a laminate glove constructed according to the present invention.
Figure 2:
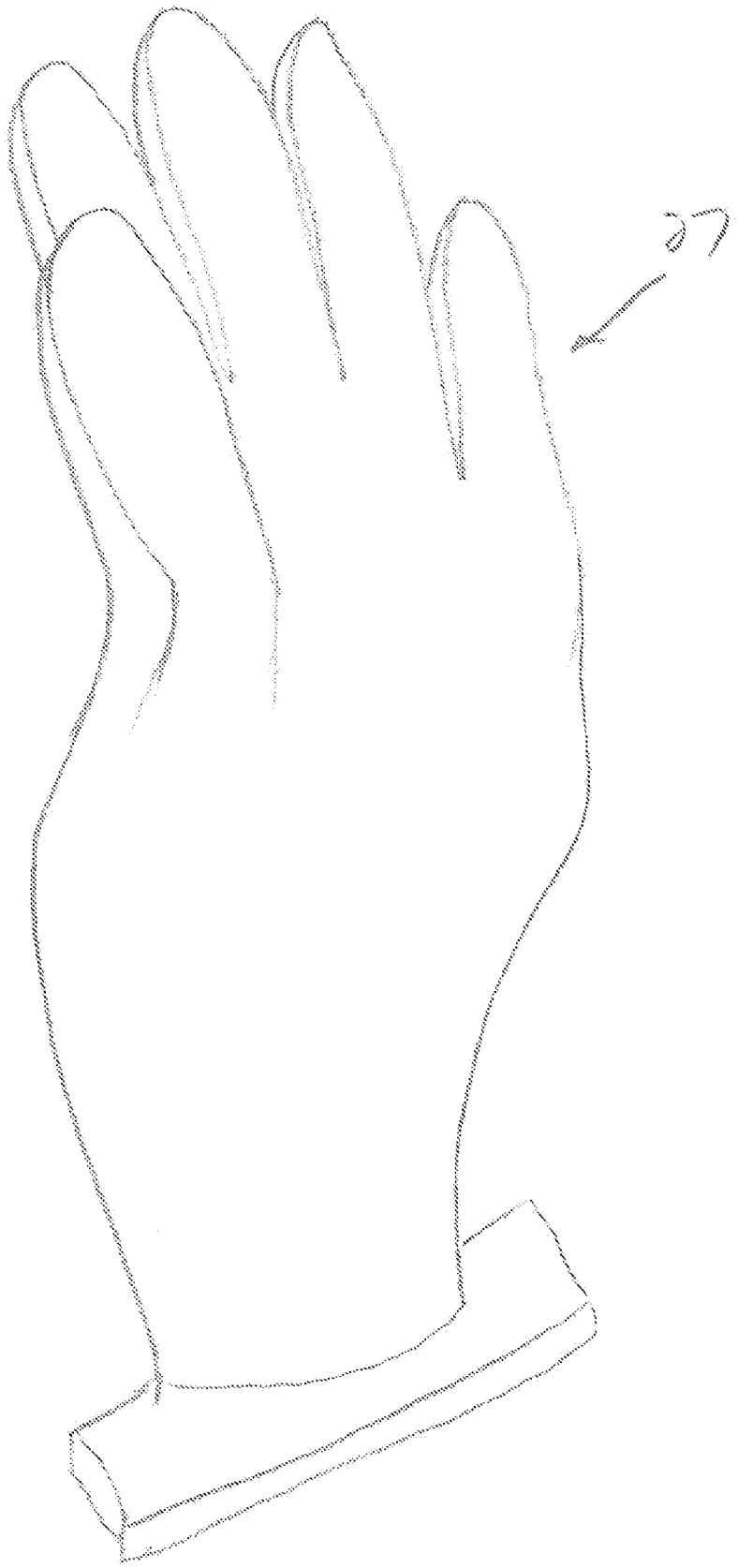
FIG. 2 is a perspective view of a form used in the construction of the glove of FIG. 1.

With reference now to the drawing figures in which like reference numerals designate like parts throughout the disclosure, a glove constructed according to the present invention is indicated generally at 10 in FIG. 1. The glove 10 includes a back portion 12 and a palm portion 14 that are joined to or formed integrally with one another along their periphery to form the majority of the glove 10. A number of finger stalls 16 extend outwardly from the back portion 12 and the palm portion 14, in addition to a thumb stall 18 spaced from the finger stall 16.

Figure 5:
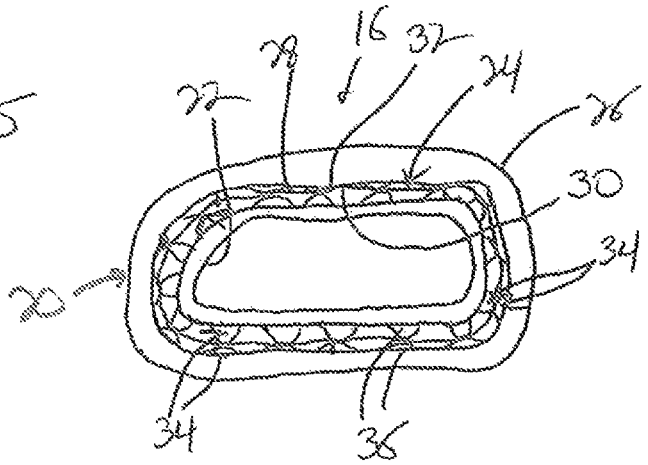
FIG. 5 is a cross-sectional view along line 5-5 of the glove of FIG. 1.

Looking now at FIGS. 1-5, the glove 10 is formed of a laminate material 20, best shown in FIG. 5, that in the illustrated embodiment includes an inner layer 22, an intermediate layer 24 and an outer layer 26, each of which are formed in a suitable manner to have a shape corresponding and complementary to the shape of a form 27 (FIG. 2) on which the layers 22, 24 and 26 are positioned to form the glove 10. However, it is also contemplated that the glove 10, or other articles of clothing, can be formed with only two layers, one of which is the intermediate layer 24, or with more than three layers, in which multiple inner layers 22, intermediate layers 24 and/or outer layers 26 can be utilized. Further, other layers, such as discontinuous layers 29 (FIG. 1) can be placed on the inner layer 22 and/or outer layer 26 of the glove 10, such as wear pads or grip enhancement structures, to provide additional functionality to the glove 10.

The shape of the form 27 is designed to provide a pre-curvature or pre-curved shape to the various glove layers 22, 24, 26 positioned thereon, such that the glove 10 constructed on the form 27 is created to mimic the natural relaxed position of a hand of a wearer. In this configuration, the glove 10 inherently includes the capacity to flex into the fully open or closed positions of the hand without the need for separate accommodations made to the construction of the glove 10, including but not limited to cut outs and fabric sections formed of different materials than the layers 22, 24, 26, among others.

The inner layer 22 can be formed of any suitable material capable of providing the desired attributes to the interior of the glove 10, including, but not limited to comfort, wicking, and breathability. Some exemplary materials can be those disclosed in U.S. Pat. No. 5,483,703, the entirety of which is expressly incorporated herein by reference, and include breathable materials formed of fabrics including natural fibers, synthetic fibers, and combinations thereof. The inner layer 22 can be placed on the form 27 such that the inner layer 22 conforms closely to the shape of the form 27, thereby giving a pre-curved shape to the inner layer 22 that approximates the position of a relaxed hand.

The outer layer 26 can also be formed of any suitable material capable of providing the desired attributes to the exterior of the glove 10, including but not limited to, breathability, cut resistance, capacitive interaction/functionality, insulation and cut and/or wear resistance, pathogen, chemical, and/or radioactivity resistance, wicking and temperature control, among others.

The intermediate layer 24 in the illustrated embodiment takes the form of a bladder 28 formed of a suitable material, such as those disclosed in U.S. Pat. No. 5,483,703, the entirety of which is expressly incorporated herein by reference, and include breathable materials, such as those formed of thermoplastic material. The bladder 28 is formed of one or more sheets of the desired thermoplastic material and includes an interior surface 30 and an exterior surface 32. In one exemplary embodiment, an amount of a heat-curable adhesive 34 that has a softening point or temperature well below that of the bladder 28 and layers 22, 26, or any other components of the glove 10 is positioned on the interior surface 30 and exterior surface 32 of the bladder 28. However, in an alternative embodiment, the bladder 28 itself can be formed with one or more layers, at least one of which is a suitable material or film having a melting point lower than the remainder of the bladder 28 that functions as the adhesive without the need to apply a separate adhesive layer to the surfaces of the bladder 28. While any suitable heat-curable thermoplastic material or adhesive can be utilized, some examples of adhesives 34 that can be used for this purpose are disclosed in U.S. Pat. No. 5,483,703, the entirety of which is expressly incorporated herein by reference.

The adhesive 34 is positioned on the interior surface 30 and the exterior surface 32 of the bladder 28 in a continuous or non-continuous manner, and in one embodiment the adhesive 34 is placed on the bladder 28 in the form of individual dots 36 of adhesive 34 on the bladder 28. In this embodiment, the adhesive 34 is placed on the bladder 28 in a regular pattern but optionally in a non- or discontinuous pattern to enhance the application of the adhesive 34 to all areas of the bladder 28, thereby enhancing the ability of the adhesive 34 to bond the bladder 28 to the inner layer 22 and the outer layer 26 greatly improving the liner retention of the resulting glove 10. Further, in this exemplary embodiment, the regular or uniform position of dots 36 on the bladder 28 results in coverage of the bladder 28 with the adhesive 34 over less than 50% of the overall surface area of the interior surface 30 and exterior surface 32 of the bladder 28, with coverage of less than 30% of the surface area, or less than 20% of the surface area also be achievable. In each embodiment, the amount of adhesive 34 present in the form of the dots 36 is still able to secure the bladder 28 to the layers 22, 26 without negatively affecting the ability of the bladder 28 and layers 22,26 to stretch and flex with regard to one another under the influence of the hand of a wearer when the hand is positioned within the glove 10. This percentage of coverage of the adhesive 34 on the bladder 28 is also applicable to the embodiment where the adhesive 34 is formed as a portion of the intermediate layer 24, whether as a portion of the bladder 28 or a portion of any one layer of a multi-layer intermediate layer 24.

In placing the adhesive 34 on the bladder 28 in a non-continuous manner, the adhesive 34 does not obstruct significant sections 37 of the surfaces 30 and 32 of the bladder 28, such that the adhesive 34 allows the bladder 28 to maintain much of its functionality concerning the breathability of the bladder 28 in these sections 37. In addition, this configuration for the adhesive 34 enables the bladder 28 to remain flexible and stretchable in those sections 37 of the bladder 28 between the sections including the adhesive 34. Further, the application of the adhesive 34 in the form of dots 36 or a similar configuration enables the adhesive 34 to remain localized when activated, further enabling the bladder 28 and other layers 22 and 26 to retain their functionality.

In alternative embodiments, the adhesive 34 can be applied to or formed as a part of the interior surface 30 and exterior surface 32 of the bladder 28 in greater concentrations on certain pets of the bladder 28 to enhance the adherence of the bladder 28 to the inner layer 22 and outer layer 26 at those locations. For example, the adhesive 34 can be applied or formed in higher concentrations, e.g., continuously over the palm and at the fingertips of the bladder 28, while being applied or formed in lower concentrations, e.g., as dots 36 or not present at all, on the portions of back of the bladder 28. This allows the bladder 28 to be adhered to the inner layer 22 and outer layer 26 at those locations where adherence is required or other features, e.g., breathability, are not as important, such as on the palm when the glove 10 includes a dipped coating over the palm, while reducing the amount of adhesive 34 at unnecessary locations, such as on the back of the glove 10 to maximize the breathability of the glove 10. Further, by forming the glove 10 with the pre-curved shape on the form 27, it is possible to place more adhesive 34 at certain portions of the glove 10 because the shape of the form 27 provides the glove 10 with the inherent flexibility to the open and closed positions regardless of the amount of adhesive 34 securing the bladder 28 to the inner layer 22 and the outer layer 26.

To assist in accomplishing this, in one embodiment of the glove 10, the adhesive 34 is applied in the form of dots 36 and then allowed to cool, to enable the bladder 28 to be moved and positioned during the formation of the glove 10 without the adhesive 34 sticking to any undesired surfaces until heat is applied thereto.

Figure 3:
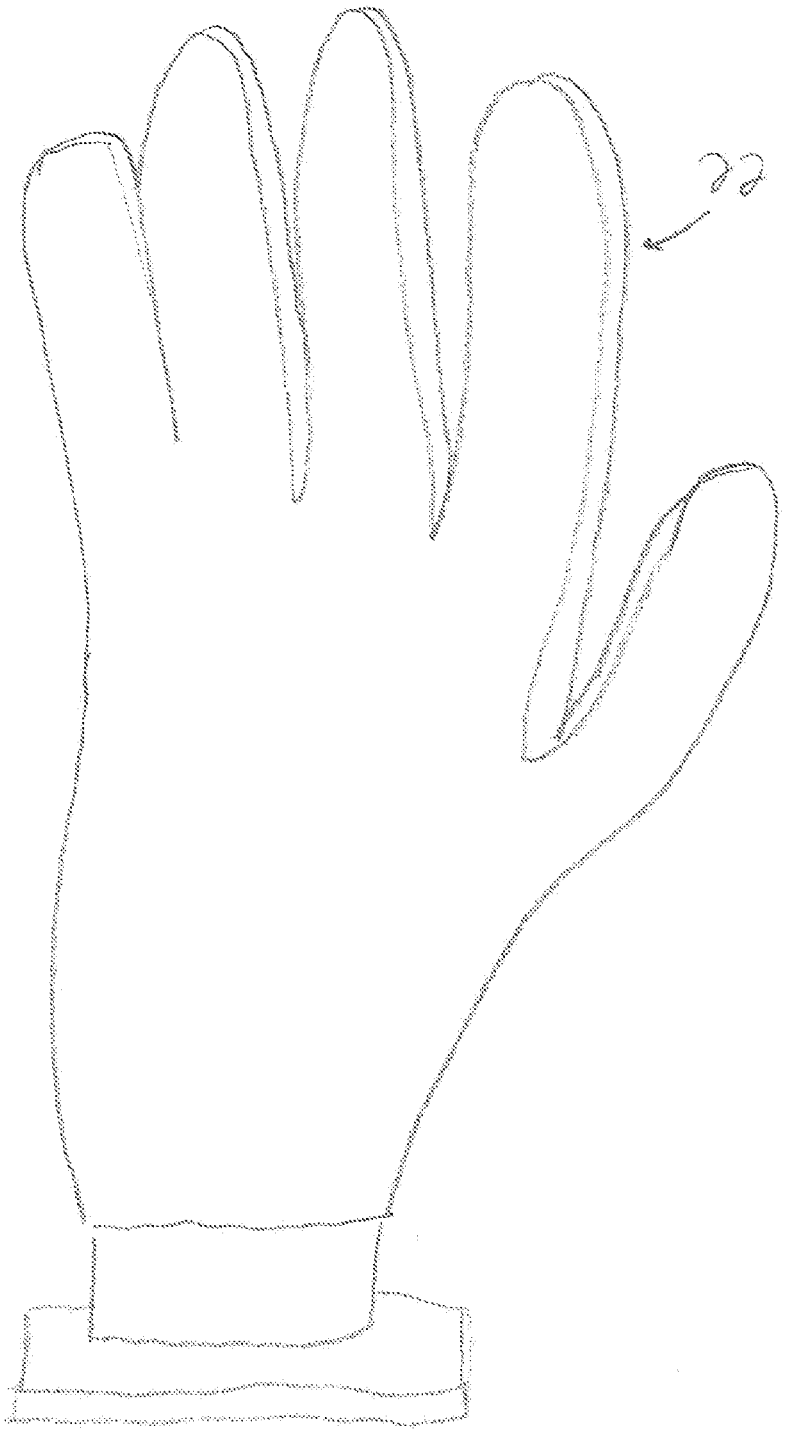
FIG. 3 is a perspective view of an inner layer of the laminate glove of FIG. 1 positioned on the form of FIG. 2.
Figure 4:
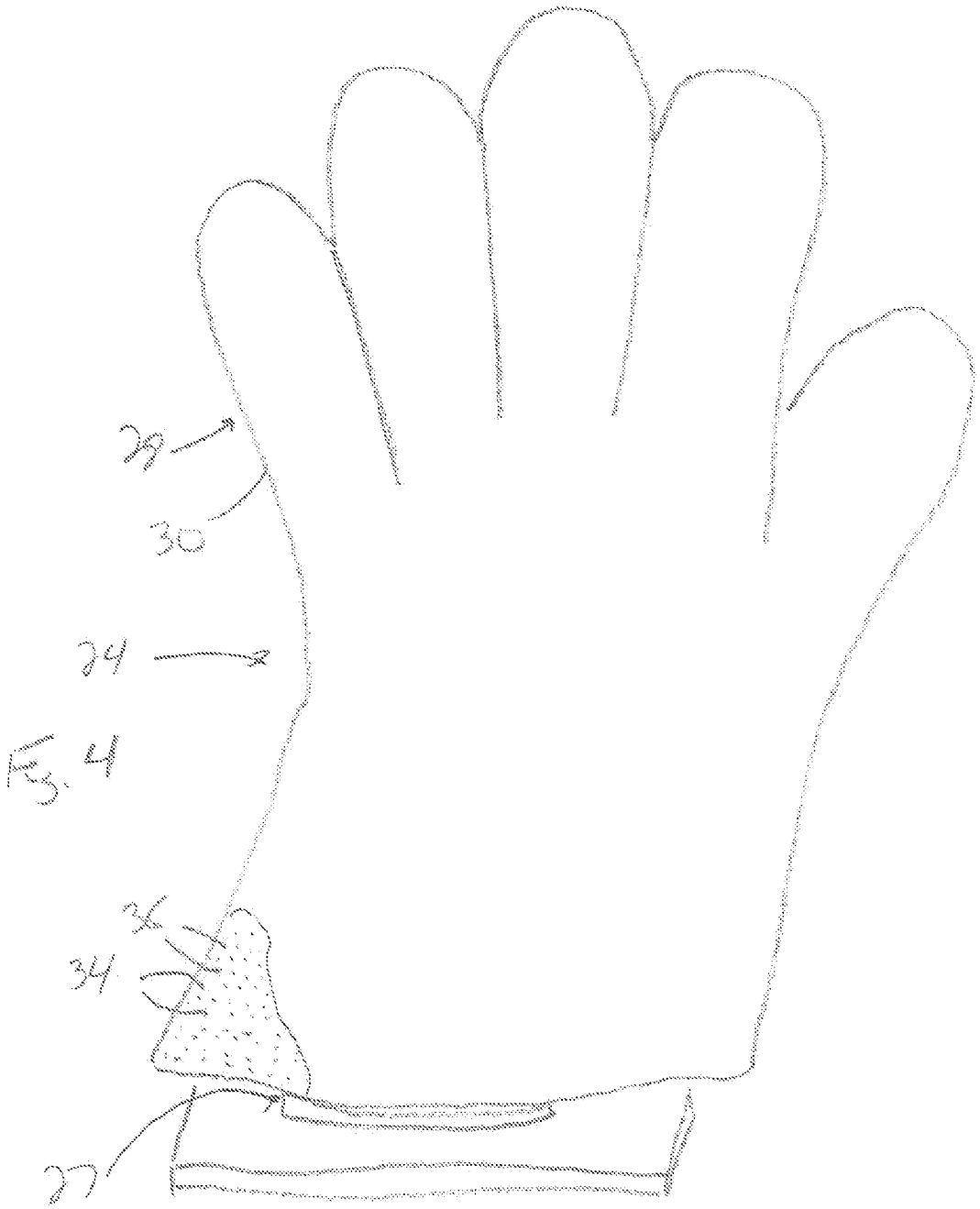
FIG. 4 is a perspective view of an intermediate layer of the glove of FIG. 1 positioned on the form of FIG. 2.

To assemble the glove 10, initially the inner layer 22 is formed and placed on the form 27 to impart the desired shape to the inner layer 22 (FIG. 3). The intermediate layer 24 formed of the bladder 28 with the adhesive 34 placed on or formed as a part of the interior surface 30 and exterior surface 32 is then positioned on the form 27 over the inner layer 22. Finally, the outer layer 26 is placed on the form 27 over the intermediate layer 24.

When placed in this loose laminate configuration, the bladder 28 extends into contact with portions of the inner layer 22 and outer layer 26 in order to securely bond the adhesive 34 positioned on the surfaces 30 and 32 of the bladder 28 between the layers 22, 24 and 26, while also conforming to the pre-shaped configuration provided to the glove 10 by the form 27.

The form 27 and each of the layers 22, 24 and 26 are then heated to activate the adhesive 34 and enable the adhesive 34 to form stable and permanent bonds between the bladder 28 and each of the inner layer 22 and the outer layer 26. In one embodiment, the heating of the layers 22, 24 and 26 on the form 27 to form the glove 10 is performed by introducing a supply of heated air into an enclosure containing the form 27 and the layers 22, 24 and 26, thereby activating the adhesive 34 to form the glove 10. In another embodiment, the supply of heated air can be used to activate the adhesive 34 without any associated compressing of the layers 22, 24 and 26 into engagement with one another, as the heated air and the positioning of the layers 22, 24 and 26 on the form 27 are sufficient to engage the layers 22, 24 and 26 with one another to produce the glove 10 having the desired laminate construction with the pre-shaped configuration. In this embodiment where the glove 10 is assembled without compression of the layers 22,24,26, the lack of compression refers to the lack of any external force applied to any of the layers 22,24,26 to move the layers into closer engagement with one another. However, should one or more of the layers 22,24,26 be formed of a flexible or stretchable material having a resultant compressive force on the other layers of the glove 10, this compressive force provided by the particular layer is not excluded by the recitation of without compression in the disclosure.

In still another embodiment, the heating step with the application of heated air can take place in an oven heated to a temperature capable of activating the adhesive without degrading any other portions of the layers 22, 24 or 26. In one embodiment, the temperature to which the oven is heated can be between 200° F. and 300° F., though other temperatures are possible depending on the particular type of adhesive used and the types of materials used to form the various layers 22, 24 and 26 of the glove 10. As an optional final step for the process of forming the glove 10, the form 27 and heated layers 22, 24, 26 can be removed from the heated enclosure and manipulated, such as by hand, to enhance the conformance of the layers 22,24,26 to the shape of the form 27.

Alternatively, the adhesive 34 can be applied to those surfaces of the inner layer 22 and/or outer layer 26 that are contacted by the intermediate layer 24, optionally in addition to the adhesive 34 being positioned on or formed as part of the intermediate layer 24. Further, in the embodiment where the adhesive 34 is formed by the dots 36, when heated the dots 36 do not form a continuous layer on the interior surface 30 and exterior surface of the intermediate layer 24, but only adhere the intermediate layer 24 to the inner layer 22 and outer layer 26 at discrete points corresponding to the locations of the dots 36.

Various alternatives are contemplated as being within the scope of the following claims particularly pointing out and distinctly claiming the subject matter regarded as the invention.

What is claimed is:

1. A glove comprising:

a) an inner layer; and b) an intermediate layer positioned adjacent to the inner layer; and c) an adhesive positioned on the intermediate layer to secure the intermediate layer to the inner layer, wherein the adhesive is positioned on less than 50% of an interior surface of the intermediate layer.

2. The glove of claim 1 wherein the adhesive is formed as at least a portion of the intermediate layer.

3. The glove of claim 2 wherein the intermediate layer is formed of a thermoplastic material.

4. The glove of claim 3 wherein the intermediate layer includes at least one layer formed of a thermoplastic material having a softening point below that of a remainder of the intermediate layer.

5. The glove of claim 1 wherein the adhesive is positioned in a uniform pattern on the intermediate layer.

6. The Wove of claim 5 wherein the adhesive is positioned in a discontinuous pattern on the intermediate layer.

7. The glove of claim 6 wherein the adhesive is completely omitted on sections of the intermediate layer.

8. The glove of claim 7 wherein the sections are located on an interior surface of the intermediate layer and an exterior surface of the intermediate layer adjacent an outer layer.

9. The glove of claim 8 wherein the sections are located on a back of the glove.

10. The glove of claim 5 wherein the adhesive is concentrated on portions of the intermediate layer.

11. The glove of claim 10 wherein the portions are located on a palm of the glove.

12. A method of forming a glove comprising the steps of:

a) placing a first layer formed of one of at least one inner or outer layer or an intermediate layer on a form to provide a pre-shaped configuration to the first layer;

b) placing a second layer formed of the other of the at least one inner or outer layer or the intermediate layer on the form over the first layer such that the adhesive on the intermediate layer contacts the at least one inner or outer layer; and c) applying heat to the adhesive to activate the adhesive to form bonds between the adhesive and the at least one inner or outer layer and the intermediate layer, wherein the at least one inner or outer layer and the intermediate layer are not compressed into engagement with one another.

13. The method of claim 12 further comprising the step of placing a third layer on the form over the second layer to contact the second layer prior to applying heat to the adhesive.

14. The method of claim 12 wherein the step of applying heat to the adhesive comprises placing the form, the first layer and the second layer in an oven.

15. A method of forming an article of clothing comprising the steps of:

a) providing at least one inner or outer layer and an intermediate layer secured to the at least one inner or outer layer, wherein the intermediate layer includes an adhesive positioned in a discontinuous pattern thereon to secure the intermediate layer to the at least one inner or outer layer;

b) placing one of the at least one inner or outer layer or the intermediate layer on a form to provide a pre-shaped configuration to the layer;

c) placing the other of the at least one inner or outer layer or the intermediate layer on the form over the first layer such that the adhesive on the intermediate layer contacts the at least one inner or outer layer in the pre-shaped configuration and d) applying heat without compression to the adhesive to activate the adhesive to form bonds between the adhesive and the at least one inner or outer layer and the intermediate layer.

* * * * *